US005165609A

United States Patent [19]

Gorynin et al.

[11] Patent Number: 5,165,609

[45] Date of Patent: Nov. 24, 1992

[54] METHOD OF PRODUCING THERMALLY REACTIVE POWDERS USING CONSUMABLE DISINTEGRATOR DISKS

[75] Inventors: Igor V. Gorynin; Boris V. Farmakovsky; Alexander P. Khinsky; Karina V. Kalogina, all of Leningrad, U.S.S.R.; Alfredo Riviere V., Caracas, Venezuela; Julian Szekely, Weston, Mass.; Navtej S. Saluja, Cambridge, Mass.

[73] Assignee: Technalum Research, Inc., Cambridge, Mass.

[21] Appl. No.: 755,071

[22] Filed: Sep. 5, 1991

[51] Int. Cl.[5] ..... B05D 7/00

[52] U.S. Cl. ..... 241/30; 241/296; 427/11; 427/216; 427/217

[58] Field of Search ..... 241/261.3, 30, 296, 241/297, 298; 427/11, 216, 217

[56] References Cited

U.S. PATENT DOCUMENTS

| | | | |
|---|---|---|---|
| 2,378,588 | 6/1945 | Skehan et al. | 427/11 |
| 3,229,923 | 1/1966 | Conley et al. . | |
| 3,338,688 | 8/1967 | Lange . | |
| 3,781,170 | 12/1973 | Iyakao et al. | 427/217 X |
| 3,817,460 | 6/1974 | Alpha . | |
| 4,024,295 | 5/1977 | Chase et al. | 427/217 X |
| 4,830,293 | 5/1989 | Forvichi et al. | 241/297 X |
| 4,857,359 | 8/1989 | Groher et al. | 427/11 X |
| 5,074,908 | 12/1991 | Boswell et al. | 427/216 X |

FOREIGN PATENT DOCUMENTS

| | | |
|---|---|---|
| 322340 | 5/1975 | Austria . |
| 325396 | 10/1975 | Austria . |
| 362289 | 5/1981 | Austria . |
| 1291605 | 3/1969 | Fed. Rep. of Germany . |
| 1296943 | 6/1969 | Fed. Rep. of Germany . |
| 1560321 | 4/1990 | U.S.S.R. . |
| 943319 | 12/1963 | United Kingdom . |
| 1101981 | 2/1968 | United Kingdom . |
| 1170792 | 11/1969 | United Kingdom . |
| 1335922 | 10/1973 | United Kingdom . |
| 202693A | 11/1979 | United Kingdom . |
| 2047104A | 2/1980 | United Kingdom . |

*Primary Examiner*—Douglas D. Watts
*Attorney, Agent, or Firm*—Choate, Hall & Stewart

[57] ABSTRACT

The method of preparing metal-coated metals includes providing a metal powder and a disintegrator with a working chamber equipped with counter-rotating disks. At least one of said disks is made of a material softer than said metal powder. The metal powder is introduced into the working chamber and the disks of the disintegrator are counter-rotated so as to cause the metal powder to strike the disks, whereby the disk is eroded by the colliding metal particles and a coating of the eroded material is formed on the metal powder and the metal-coated metal particles are collected at the exit end of the disintegrator.

17 Claims, 1 Drawing Sheet

METHOD OF PRODUCING THERMALLY REACTIVE POWDERS USING CONSUMABLE DISINTEGRATOR DISKS

BACKGROUND OF THE INVENTION

The present invention relates to thermally reactive powders and a method for their preparation. The present invention further relates to aluminum-coated powders useful in the preparation of intermetallic compounds.

Intermetallic materials, particularly those containing aluminum are known to have good ductility at room temperature, high creep strength, high tensile strength and high resistance to oxidation. The intermetallic phases are usually formed from alloys, however, and it is difficult to form homogeneous materials. In addition, it is difficult to process the alloys into useful materials in the desired final shape.

Thermally reactive powders are used in reactive sintering which is a form of self-propagating high temperature synthesis (SHS). Reactive sintering is accomplished by the formation of a transient liquid phase during the exothermic reaction between the two species of metal powder. The two species are randomly mixed in a near stoichiometric ratio and the mixture is heated under controlled atmosphere, heating rate, time and temperature. At the lowest eutectic temperature in the system, liquid forms and rapidly spreads throughout the structure. The liquid consumes the elemental species and generates an intermetallic species. The interdiffusion of the elements is rapid in the liquid phase and the compound generates heat which accelerates the reaction. In this way it is possible to form a nearly fully dense material.

The close proximity of the two metal species to one another is important in achieving a smooth continuous reaction. One way of obtaining the close contact of the two materials is to coat one with the other.

A conventional method of preparing thermally reactive powders is the direct alloying of metals. In this method a first metal is melted in a heated vessel and a second metal is introduced, whereby a reaction of the two metals takes place, releasing heat and forming a mixture of intermetallic compounds and alloys. The mixture is cooled and the solidified melt is ground into a powder. A significant amount of the starting metal is prereacted during this process which results in a low exothermic effect upon subsequent reaction of the thermally reactive powders.

Metal-coated metals have also been prepared by coating the core metal with an organic binder and adhering the second coating metal onto its surface. However, the coating does not adhere well and impurities (decomposition products of the organic binder) are introduced into the powder during the thermal reaction.

Coating a core metal with a metal salt solution of the second metal followed by thermal decomposition of the metal salt has been used to obtain metal-coated metals. Decomposition of the deposited metal salt results in gas evolution and precipitate formation, thus compromising the quality of the metal coating. Degradation of the metal salt layer in the presence of hydrogen leads to cleaner decomposition products, however, impurities still remain.

It is the object of the present invention to prepare metal-coated metals useful in processes such as reactive sintering. It is a further object of the present invention to prepare metal-coated metal particles that are free from impurities and additives.

SUMMARY OF THE INVENTION

In one aspect of the present invention, a method for preparing metal-coated metal particles is provided. A metal powder, used as the metal core of the metal-coated metal is provided. A disintegrator with counter-rotating disks is provided in which at least one of the counter-rotating disks is made of a material softer than the metal powder. The powder is introduced into the disintegrator and the disks are counter-rotated so as to cause the metal powder to strike the disks. Because the disk is made of a softer material than the metal powder, it is eroded by the impact of the metal powder and the harder metal powder is coated by the softer material of the rotating disk.

In preferred embodiments, the disks rotate preferably at a rate of at least 3600 rpm and more preferably at a rate of 8000–21,000 rpm. Either one or both disks can be made of the softer material. As the disks counter-rotate, the powder collides with the teeth of the disk. Impact velocities are preferably at least 150 m/s and more preferably 200 to 400 m/s. Higher impact velocities increase the erosion of the disk.

In other preferred embodiments, the particle size of the metal powder is preferably less than 200 μm and more preferably 60–90 μm. The process can be carried out in a vacuum, under inert atmosphere, in air or in a weakly reducing atmosphere. The metal powder is preferably any transition metal or its alloys. More preferably the metal powder is Co, Cr, Mo, Ta, Nb, Ti or Ni or their alloys.

In preferred embodiments, the teeth on the disintegrator disk are shaped for maximum wear. The cross-section of the teeth is preferably rectangular or trapezoidal.

Metal-coated metal powders prepared according to the method of the present invention are free of impurities and additives. There is an intimate contact of the two metals, which makes them well-suited for use in reactive sintering processes and flame spraying processes.

DESCRIPTION OF THE PREFERRED EMBODIMENT

Figure 1:
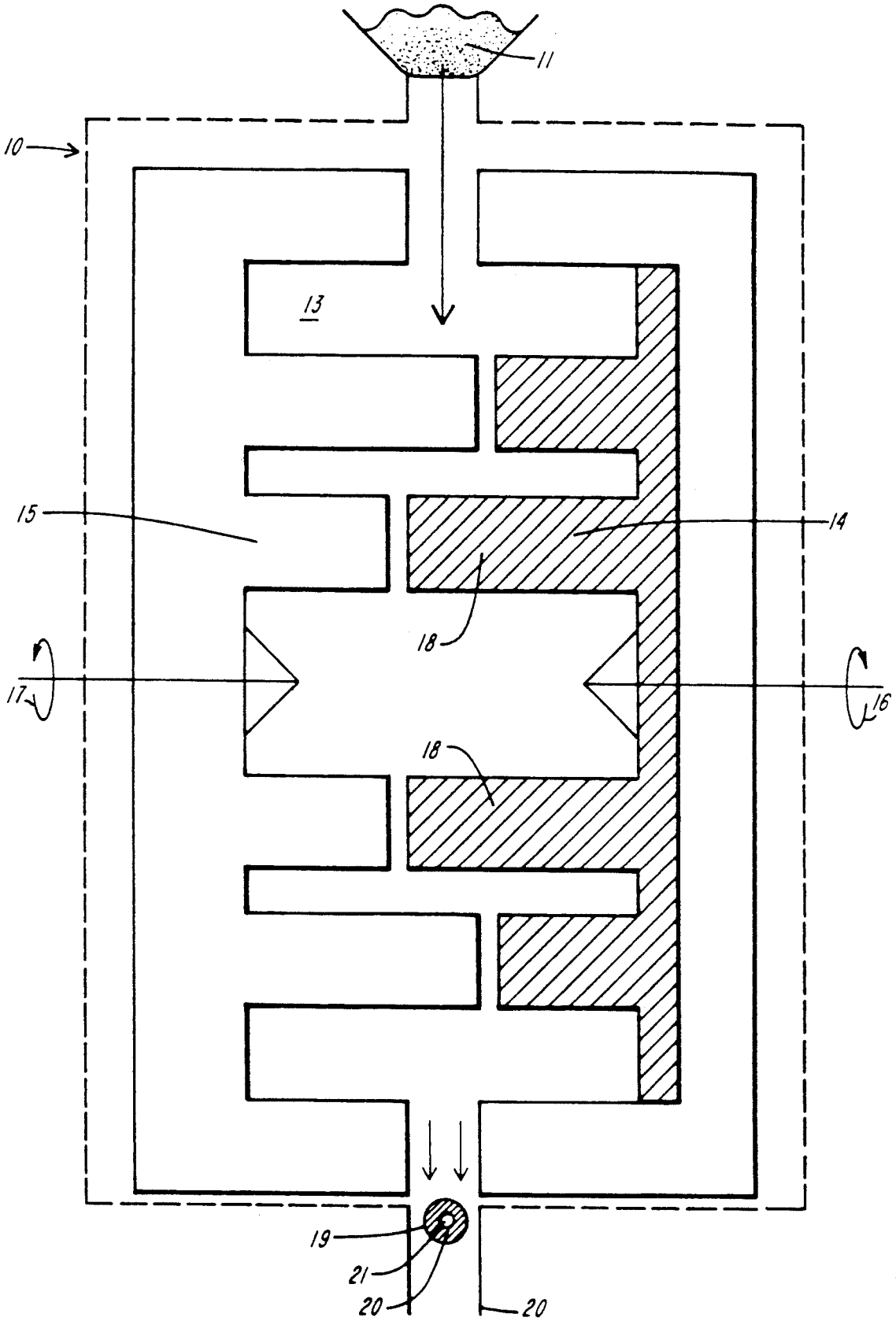
FIG. 1 shows a cross-sectional view of the disintegrator used in the powder coating process of the invention.

As heretofore described, the present invention relates to coated metal powders and a method for their preparation.

A disintegrator apparatus 10 used in this invention is shown in FIG. 1. A hard metal powder 11 is introduced into a disintegrator chamber 13 which contains two counter-rotating disks 14 and 15. Disk 14 is made of a material softer than that of the metal powder 11. Disks 14 and 15 rotate in directions indicated by arrows 16 and 17, respectively. Teeth 18 of the counter-rotating disks 14 are designed so as to experience maximum wear as the metal powder 11 strikes their surfaces. Upon contact, the harder metal powder 11 is coated by the softer material of disk 14 to obtain a metal-coated metal powder 19 which is collected at an exit end 20 of the chamber 13. The metal-coated metal particle 19 has an outer coating 21 made up of the material of the erodible disk 14 and a core 21 made up of the metal powder 11.

The disk 14 is preferably prepared from aluminum, which is a soft material and often used in reactive sintering processes. Any transition metal harder than disk 14 can be used as the metal powder 11. Those metals useful as thermally reactive powders include Co, Cr, Mo, Ta, Nb, Ti or Ni and their alloys.

The composition of the final powder is determined by the choice of processing atmosphere. To obtain clean boundaries devoid of oxide contamination, processing in inert atmospheres or a vacuum is preferred. Weakly reducing atmospheres will further prevent the formation of an oxide "skin" on the powders. Air can be used as the processing atmosphere in instances where oxygen sensitivity of the powder is not a problem.

In a typical example, cobalt powders (63-100 μm) were used as the hard metal powder. The disk 14 was made of pure aluminum. The disks were counter-rotated at 15,000-18,000 rpm. Aluminum-coated cobalt particles were obtained with a 1-3 μm thick aluminum coating. A cross-sectional view of the particles showed no transitional layer at the Al-Co interface. The bond was strong as evidenced by the lack of gaps, delamination or other defects along the Al-Co interface.

What is claimed is:

1. A method for preparing metal-coated metal particles comprising the steps of:

providing a metal powder and a disintegrator with a working chamber equipped with counter-rotating disks, at least one of said disks comprising a material softer than said metal powder;

introducing said metal powder into said working chamber;

counter-rotating the disks of said disintegrator so as to cause said metal powder to strike said disks, whereby the disk composed of said material softer than said metal powder is eroded by the colliding metal particles and a coating of said eroded material is formed on said metal powder; and collecting said metal-coated metal particles at an exit end of said disintegrator.

2. The method of claim 1 wherein one of said counter-rotating disks is comprised of said material softer than said metal powder.

3. The method of claim 1 wherein both of said counter-rotating disks is comprised of said material softer than said metal powder.

4. The method of claim 1 wherein said disks rotate at a rate of 8000-21,000 rpm.

5. The method of claim 1 wherein said disks rotate at a rate of 15,000-18,000 rpm.

6. The method of claim 1 wherein said metal powder strikes said disks with a velocity of at least 150 m/s.

7. The method of claim 1 wherein said metal powder strikes said disks with a velocity of 200 to 400 m/s.

8. The method of claim 1 wherein the particle size of said metal powder is less than 200 μm.

9. The method of claim 1 wherein the particle size of said metal powder is 60 to 90 μm.

10. The method of claim 1 wherein said process is carried out under an inert atmosphere.

11. The method of claim 1 wherein said process is carried out in a vacuum.

12. The method of claim 1 wherein said process is carried out in air.

13. The method of claim 1 wherein said process is carried out in a weakly reducing atmosphere.

14. The method of claim 1 wherein the cross-section of the teeth of said disks is rectangular or trapezoidal.

15. The method of claim 1 wherein said soft material is aluminum.

16. The method of claim 1 wherein said metal powder is selected from the group containing Co, Cr, Mo, Ta, Nb, Ti or Ni and their alloys.

17. The method of claim 1 wherein said metal powder is transition metal, rare earth metal, alkali metal, alkaline earth metal, Group 3a metal, Group 4a metal and their alloys.

* * * * *